US008955957B2

(12) United States Patent
Boland et al.

(10) Patent No.: US 8,955,957 B2
(45) Date of Patent: Feb. 17, 2015

(54) LAMP CONFIGURATION AND CONTROLLER FOR A RADIANT DRYER UNIT OF AN INKJET PRINTER

(75) Inventors: Stuart J. Boland, Denver, CO (US); Scott Johnson, Erie, CO (US); Constantino J. Tadiello, Fort Collins, CO (US); Casey E. Walker, Boulder, CO (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 256 days.

(21) Appl. No.: 13/468,196

(22) Filed: May 10, 2012

(65) Prior Publication Data

US 2012/0287195 A1 Nov. 15, 2012

Related U.S. Application Data

(60) Provisional application No. 61/485,047, filed on May 11, 2011.

(51) Int. Cl.

| | |
|---|---|
| ***B41J 2/01*** | (2006.01) |
| ***B41J 11/00*** | (2006.01) |
| *B41J 29/38* | (2006.01) |
| *F26B 3/00* | (2006.01) |
| *F26B 3/34* | (2006.01) |
| *F26B 7/00* | (2006.01) |
| *F26B 9/00* | (2006.01) |
| *F26B 13/00* | (2006.01) |
| *F26B 13/06* | (2006.01) |

(Continued)

(52) U.S. Cl.

CPC ..... *B41J 11/002* (2013.01)

USPC ..... 347/102; 347/16; 34/273; 34/418; 34/419; 34/444; 34/527; 34/560; 34/561; 34/611; 34/618

(58) Field of Classification Search

CPC ..... B41J 11/42; B41J 11/002; B41J 11/0015; B41J 29/38; B41J 29/393; B41M 7/0072; B41M 7/0045; B41M 7/0054; B41M 7/0081; B41M 7/009; B41M 5/405

USPC ..... 347/16, 102; 34/273, 418–419, 444, 34/527, 560–561, 611, 618

See application file for complete search history.

(56) References Cited

U.S. PATENT DOCUMENTS

| | | | | |
|---|---|---|---|---|
| 6,973,874 | B2 * | 12/2005 | DeMoore et al. | 101/424.1 |
| 7,178,913 | B2 | 2/2007 | Kumamoto et al. | |
| 7,316,476 | B2 | 1/2008 | Yokoyama | |

(Continued)

FOREIGN PATENT DOCUMENTS

| | | |
|---|---|---|
| JP | 02039940 | 8/1990 |
| JP | 2004 249473 | 9/2004 |

*Primary Examiner* — Laura Martin
*Assistant Examiner* — Jeremy Bishop
(74) *Attorney, Agent, or Firm* — Duft Bornsen & Fettig LLP

(57) ABSTRACT

Systems and methods for a dryer unit of a printer. In one embodiment, a dryer unit includes a light source having a plurality of lamps. The dryer unit further includes a controller that associates a target output power with each of the lamps of the light source. When in operation, the controller determines a speed of a printable medium that passes through the dryer unit. The controller is able to vary an intensity of light generated by the light source based on the speed of the printable medium by varying which of the lamps of the light source are energized to their target output power.

20 Claims, 6 Drawing Sheets

(51) Int. Cl.
*F26B 13/10* (2006.01)
*F26B 19/00* (2006.01)

(56) References Cited

U.S. PATENT DOCUMENTS 7,434,899 B2 10/2008 Nakajima
7,500,745 B2 3/2009 Ushirogouchi et al.
7,766,440 B2 8/2010 Kusunoki
8,162,468 B2 * 4/2012 Kulpa et al. ..... 347/102
2007/0115335 A1 5/2007 Vosahlo et al.
2008/0239044 A1 10/2008 Yokota
2009/0213200 A1 8/2009 Sugai
2009/0244230 A1 10/2009 Ohnishi et al.
2010/0149295 A1 6/2010 Kulpa et al.

* cited by examiner

LAMP CONFIGURATION AND CONTROLLER FOR A RADIANT DRYER UNIT OF AN INKJET PRINTER

RELATED APPLICATIONS

This non-provisional patent application claims priority to U.S. Provisional Patent Application No. 61/485,047 filed on May 11, 2011, which is incorporated by reference as if fully included herein.

FIELD OF THE INVENTION

The invention relates to the field of production printing systems and, in particular, to a radiant dryer unit of a printer.

BACKGROUND

Businesses or other entities having a need for volume printing typically purchase a production printing system. A production printing system comprises a high-speed printer used for volume printing, such as 100 pages per minute or more. The production printing systems are typically continuous-forms printers that print on paper or some other printable medium that is stored on large rolls. Some continuous-forms printers are able to print on paper up to 20 inches wide or more.

A production printing system typically includes a localized print controller that controls the overall operation of the printing system, and one or more print engines (sometimes referred to as an "imaging engine" or as a "marking engine"). The print engines include a printhead controller and arrays of printheads. An individual printhead includes multiple tiny nozzles (e.g., 360 nozzles per printhead depending on resolution) that are operable to discharge ink as controlled by the printhead controller. The printhead array is formed from multiple printheads that are spaced in series along a particular width, such as 20 inches.

When in operation, the printable medium is passed underneath the printhead arrays while the nozzles of the printheads discharge ink at particular intervals to form pixels on the medium. Some of the media used in inkjet printers is better suited to absorb the ink, while others are not. Thus, printing systems may be implemented with a radiant dryer unit that assists in drying the ink on the medium after the print engine discharges ink on the medium.

A typical dryer unit includes an array of lamps that emit light and heat to dry the ink onto the medium. The power applied to the lamps typically varies based on the speed of the medium as it passes through the dryer unit. As the speed of the medium increases, a higher intensity light is needed to dry the medium. In a traditional dryer unit, the power applied to the lamps of the array would increase as the speed of the medium increases. By increasing the power applied to the lamps, the intensity of the light produced by the array likewise increases to dry the medium. As the speed of the medium decreases, a lower intensity light is needed to dry the medium. Thus, the power applied to the lamps of the array would decrease as the speed of the medium decreases. By decreasing the power applied to the lamps, the intensity of the light produced by the array likewise decreases to dry the medium.

Printer manufacturers are continually trying to improve the effectiveness of radiant dryer units.

SUMMARY

Embodiments described herein provide an improved radiant dryer unit that more effectively dries a recording liquid (e.g., ink) onto a moving medium. There is an optimal light intensity and/or wavelength that can be used within a dryer unit for a specific medium/recording liquid combination. In a traditional dryer unit that varies the power applied to an array of lamps, the characteristic wavelength of the light emitted by the lamps varies as the power applied varies. Therefore, a traditional dryer unit may not be operating at the optimal wavelength at all times. In the embodiments described herein, each of the lamps of the dryer unit is energized to create a target output power. The target output power for a lamp is selected to produce at or near the optimal wavelength for drying a recording liquid onto a medium. To vary the overall intensity of the light source as the speed of the medium varies, different combinations of the lamps are energized to their target output power. For example, if low intensity light is desired in the dryer unit, then a first array of lamps may be energized to create a first target output power. If medium intensity light is desired, then a second array of lamps may be energized (instead of the first array) to create a second target output power. If high intensity light is desired, then both the first array and the second array may be energized with their respective target output powers. Even though the overall intensity of the light source varies, the wavelength of light emitted by each array stays constant at the optimal wavelength because a target output power is used for each lamp. This improves the operation of the dryer unit.

One embodiment is a dryer unit of a printer. The dryer unit includes a light source having a plurality of lamps. The dryer unit further includes a controller configured to associate a target output power with each of the lamps of the light source. The controller is further configured to determine a speed of a printable medium that passes through the dryer unit. The controller is further configured to vary an intensity of light generated by the light source based on the speed of the printable medium by varying which of the lamps of the light source are energized to create their target output power.

In another embodiment, the controller is further configured to determine a target intensity of light for the light source based on a measured speed of the printable medium, to select a combination of lamps in the light source that provides the target intensity when the lamps are energized to their target output powers, and to energize the lamps of the selected combination to their target output powers.

Another embodiment is a method of operating a dryer unit of a printer, where the dryer unit includes a light source comprising a plurality of lamps. The method includes associating a target output power with each of the lamps of the light source. The method further includes determining a speed of a printable medium that passes through the dryer unit. The method further includes varying an intensity of light generated by the light source based on the speed of the printable medium by varying which of the lamps of the light source are energized to their target output power.

The invention may include other exemplary embodiments described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
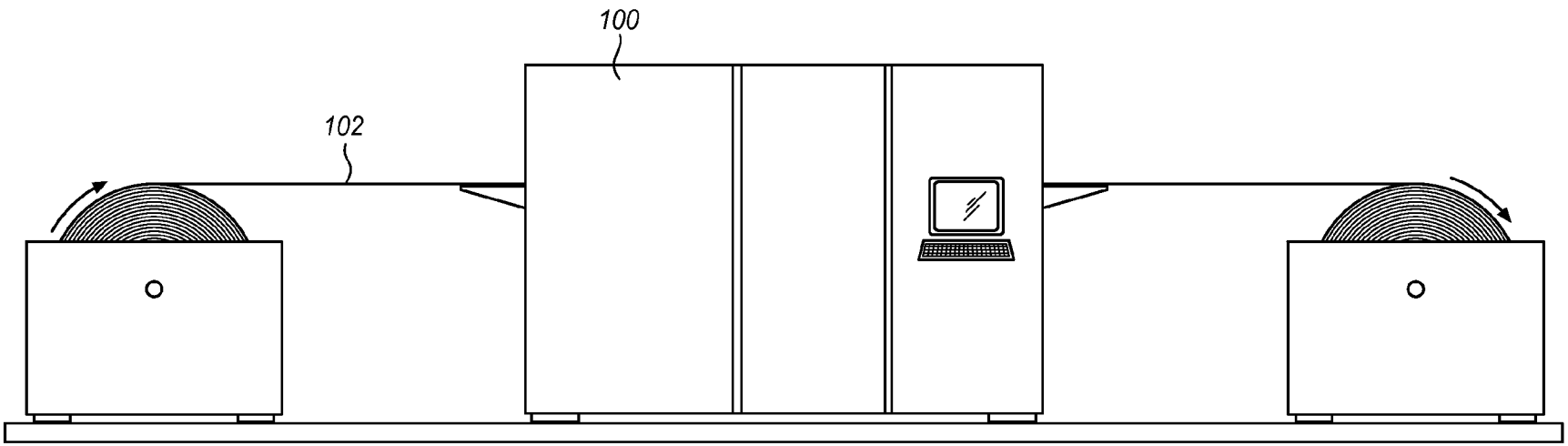
FIG. 1 illustrates a printing system in an exemplary embodiment.

FIG. 1 illustrates a printing system 100 in an exemplary embodiment. Printing system 100 comprises any continuous-forms printer used to mark a printable medium 102. In this embodiment, printing system 100 comprises a production printing system that uses a recording liquid, such as ink, to mark printable medium 102. Although not specifically shown in FIG. 1, printing system 100 includes a print controller and one or more print engines. The print engines include a print head controller and arrays of print heads that discharge the recording liquid onto medium 102 as it passes under the print heads. After a print engine discharges the recording liquid onto medium 102, printing system 100 may include a radiant dryer unit that assists in drying the recording liquid on medium 102.

Figure 2:
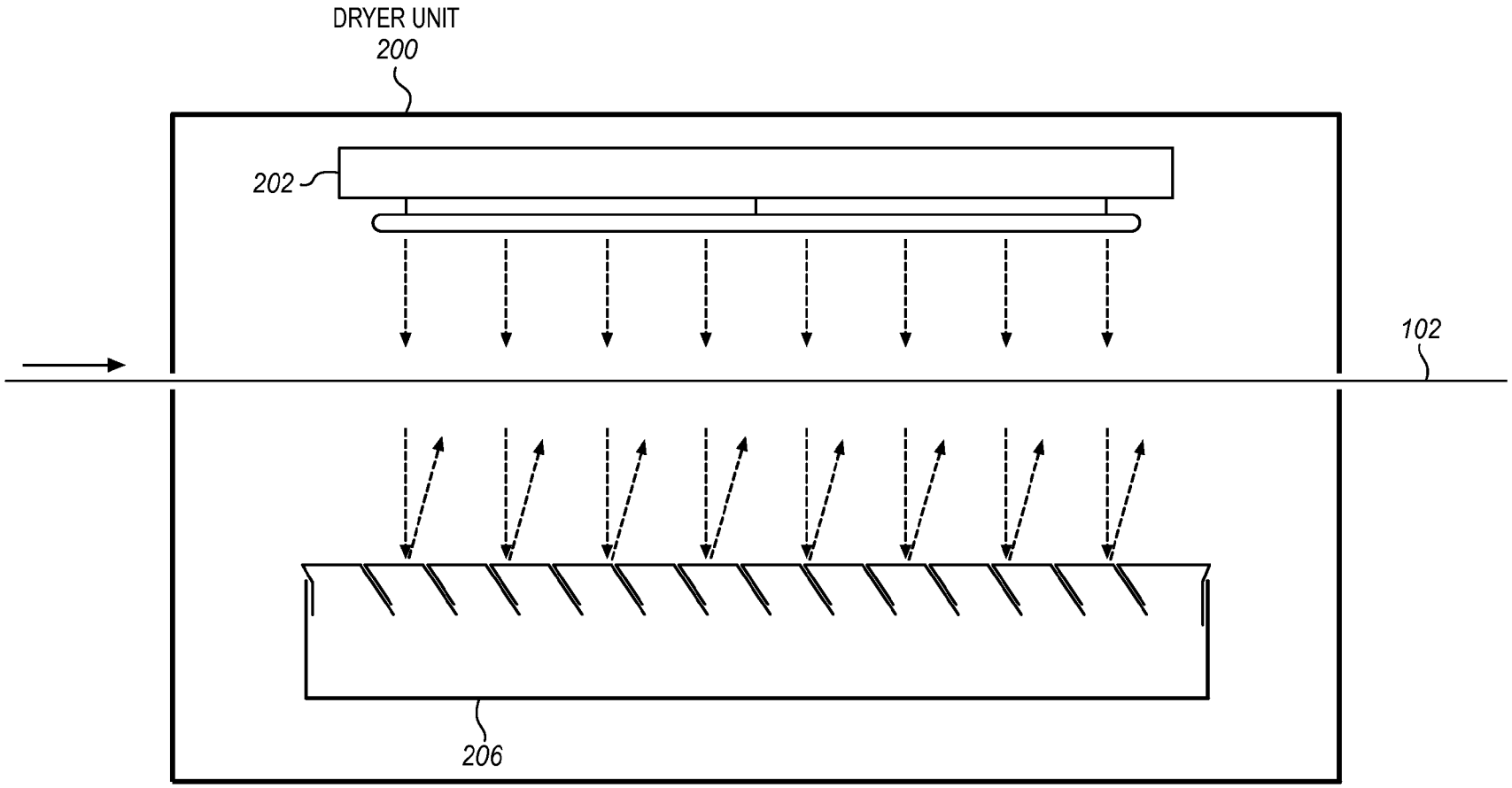
FIG. 2 illustrates a dryer unit in an exemplary embodiment.

FIG. 2 illustrates a dryer unit 200 in an exemplary embodiment. Dryer unit 200 is installed in printing system 100 after the print heads to dry the recording liquid that is printed on medium 102. Dryer unit 200 includes a light source 202 that projects light onto medium 102. For example, light source 202 may comprise one or more arrays of lamps or light bulbs. The light waves from light source 202 are illustrated as dotted arrows in FIG. 2. The radiant energy in the light waves helps to dry ink on medium 102 as the medium 102 passes through dryer unit 200. Some of the light waves may pass through or pass by medium 102 during the drying process. Thus, dryer unit 200 may also include a reflector element 206 that is opposite light source 202 (i.e., on the other side of medium 102). Reflector element 206 acts to reflect the light waves that pass through or around medium 102 back towards medium 102 to assist in the drying process.

Figure 3:
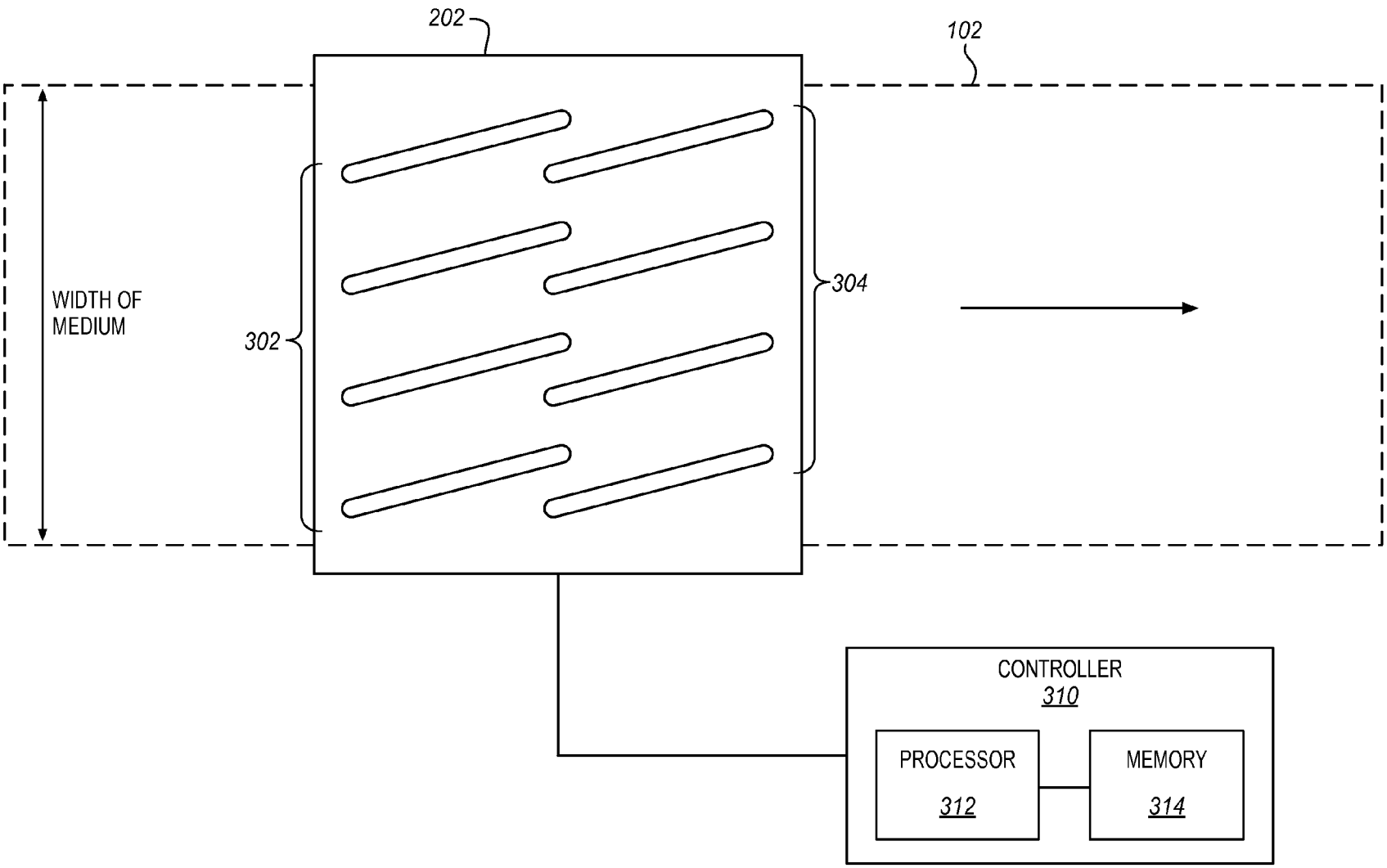
FIG. 3 illustrates a light source for a dryer unit in an exemplary embodiment.

FIG. 3 illustrates light source 202 for dryer unit 200 in an exemplary embodiment. FIG. 3 is a top view showing medium 102 passing underneath light source 202. In this embodiment, light source 202 includes a first array 302 of lamps that spans across the width of medium 102. Light source 202 also includes a second array 304 of lamps that spans across the width of medium 102. A lamp as described herein comprises any element that produces light. One example of a lamp is an infrared light bulb.

Each of the lamps in array 302 may have similar characteristics, and each of the lamps in array 304 may have similar characteristics. However, the lamps in array 302 may have different characteristics than the lamps in array 304. For example, array 302 may include lamps that produce light at an intensity $I_1$ having a wavelength of $\lambda 1$ with an applied power of P1. Array 304 may include lamps that produce light at an intensity $I_2$ having a wavelength of $\lambda 1$ with an applied power of P2. Thus, even though different powers are applied to arrays 302 and 304, the lamps are able to produce light having the same wavelength of $\lambda 1$.

The lamps utilized in arrays 302 and 304 may have a tubular shape as illustrated in FIG. 3. When tubular lamps are used, they may be positioned at an angle with respect to medium 102, which is illustrated in FIG. 3. Instead of the major axes of the lamps being parallel or perpendicular to the direction of travel of medium 102, the major axes are at an acute angle to the direction of travel of medium (which is illustrated by an arrow in FIG. 3). This angled configuration (between 0 and 90 degrees) of the lamps provides a more even temperature across medium 102. The angled configuration is just one embodiment, and lamps may be perpendicular or parallel to the direction of travel of the medium in other embodiments.

Dryer unit 200 also includes a controller that controls the operation of light source 202. FIG. 3 shows controller 310 connected to light source 202. Controller 310 is configured to vary the overall intensity of the light generated by light source 202 based on the speed of medium 102 as it passes through dryer unit 200. There is an optimal intensity of light for drying the recording liquid on medium 102 that is based on the speed of medium 102. Therefore, controller 310 is able to vary the overall intensity of light generated by light source 202 as the speed of medium 102 changes.

To vary the intensity, controller 310 selectively energizes lamps of light source 202. Each lamp of light source 202 has a target output power that is set by controller 202. The target output power for a lamp represents the power that is used to energize the lamp when it is switched on. A lamp is energized solely according to its target output power in this embodiment. Thus, if a lamp is turned on (or energized), then the lamp is energized to create its target output power. Each lamp has an effective operating power range (generally between 70-100% of full power) where the characteristic wavelength output is acceptable for the ink being applied. Therefore, a power range can be associated with each lamp as the "target output power" for that lamp. The output power can be adjusted by an operator within the power range, but does not substantially affect the lamp's characteristic output wavelength. Adjusting the output power outside of the target range is undesirable as the output wavelength would no longer be optimal for the ink.

Controller 310 includes a processor 312 and a memory 314. Memory 314 may store information, such as a table, that relates the speed of a medium to an optimum intensity of light for a light source. Memory 314 may also store information on the target output power of each lamp in light source 202. Memory 314 may further store information on the intensity of light emitted by each lamp (or array of lamps) when energized to create its target output power. Processor 312 executes the desired operational steps of controller 310, which is further illustrated in FIG. 4.

Figure 4:
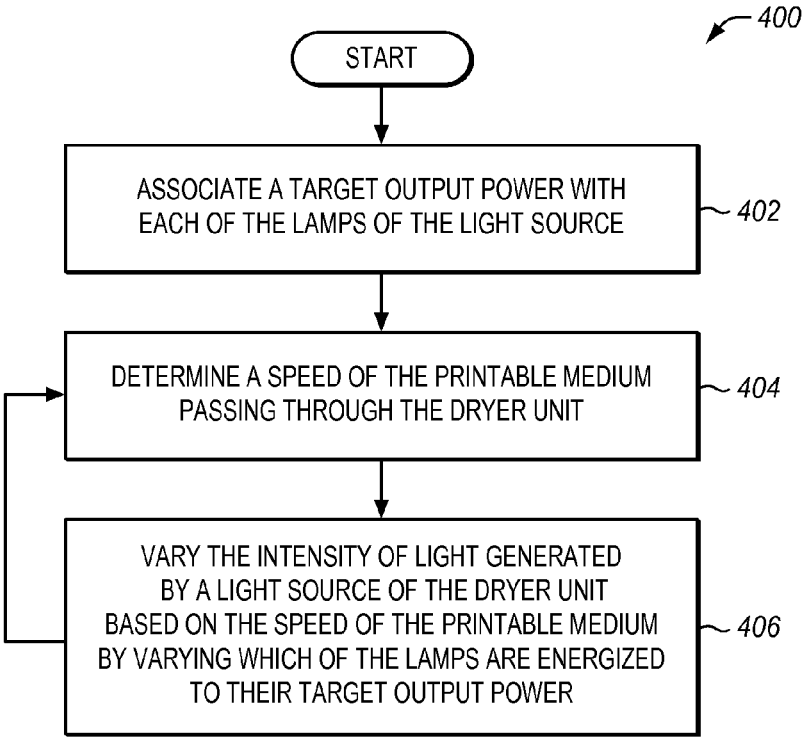
FIG. 4 is a flow chart illustrating a method of controlling a light source of a dryer unit in an exemplary embodiment.

FIG. 4 is a flow chart illustrating a method 400 of controlling light source 202 in an exemplary embodiment. The steps of method 400 will be described with reference to dryer unit 200 in FIGS. 2-3, although method 400 may be performed in other systems. The steps of the flow chart described herein are not all inclusive and may include other steps not shown. The steps may also be performed in an alternative order.

In step 402, controller 310 associates a target output power with each of the lamps in light source 202. For example, controller 310 may access a table stored in memory 314 to locate the associations between the lamps and a target output power that is preconfigured or pre-set for the lamps. In step 404, controller 310 determines a speed of medium 102 that passes through dryer unit 200. Controller 310 may be connected to a sensor or some other measurement device that measures or estimates the speed of medium 102. In step 406, controller 310 varies the intensity of light generated by light source 202 based on the speed of medium 102 by varying which of the lamps of light source 202 are energized (or turned on) to create their target output power. Thus, controller 310 is able to control the overall intensity of light generated by light source 202 by controlling which (e.g., how many) lamps are switched on to their target output power. For example, if controller 310 energizes the lamps in array 302, then controller 310 will apply power to a lamp to create an output power P1 for each of the lamps in array 302. The output power P1 of the lamps is fixed within a target range. If controller 310 energizes the lamps in array 304, then controller 310 will apply voltage/current to a lamp to create an output power P2 for each of the lamps in array 304. The output power P2 of the lamps is fixed within a target range.

Figure 5:
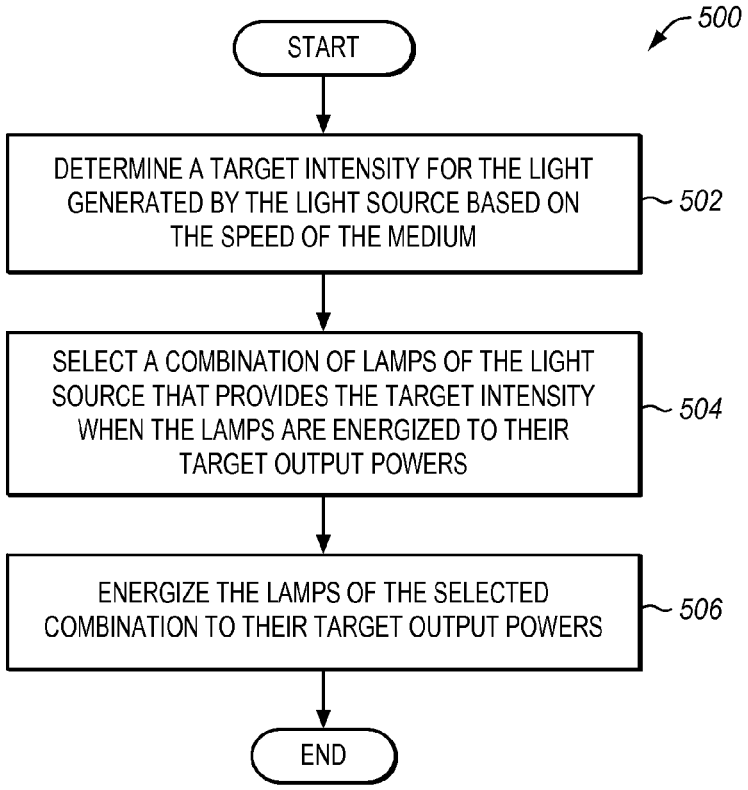
FIG. 5 is a flow chart illustrating a method of varying the intensity of light from a light source in an exemplary embodiment.

Method 400 is continually repeated so that the intensity of light generated by light source 202 is changed as the speed of medium 102 changes. One exemplary operation for varying the intensity of light generated by light source 202 is shown in FIG. 5. Assume that a speed measurement is taken for medium 102 at some point in time. FIG. 5 is a flow chart illustrating a method 500 of varying the intensity of light from light source 202 in an exemplary embodiment. In step 502, controller 310 determines a target intensity of light based on the speed of medium 102. This information may be stored in a table of memory 314. In step 504, controller 310 selects a combination of lamps in light source 202 that provides the target intensity when the lamps are energized to create their target output powers. As described above, each lamp in light source 202 has an associated target output power. Therefore, controller 310 can determine how much each lamp will contribute to the overall intensity of light source 202 according to their target output power, and select the combination accordingly. In step 506, controller 310 energizes the lamps of the selected combination by applying their target output powers.

Figure 6:
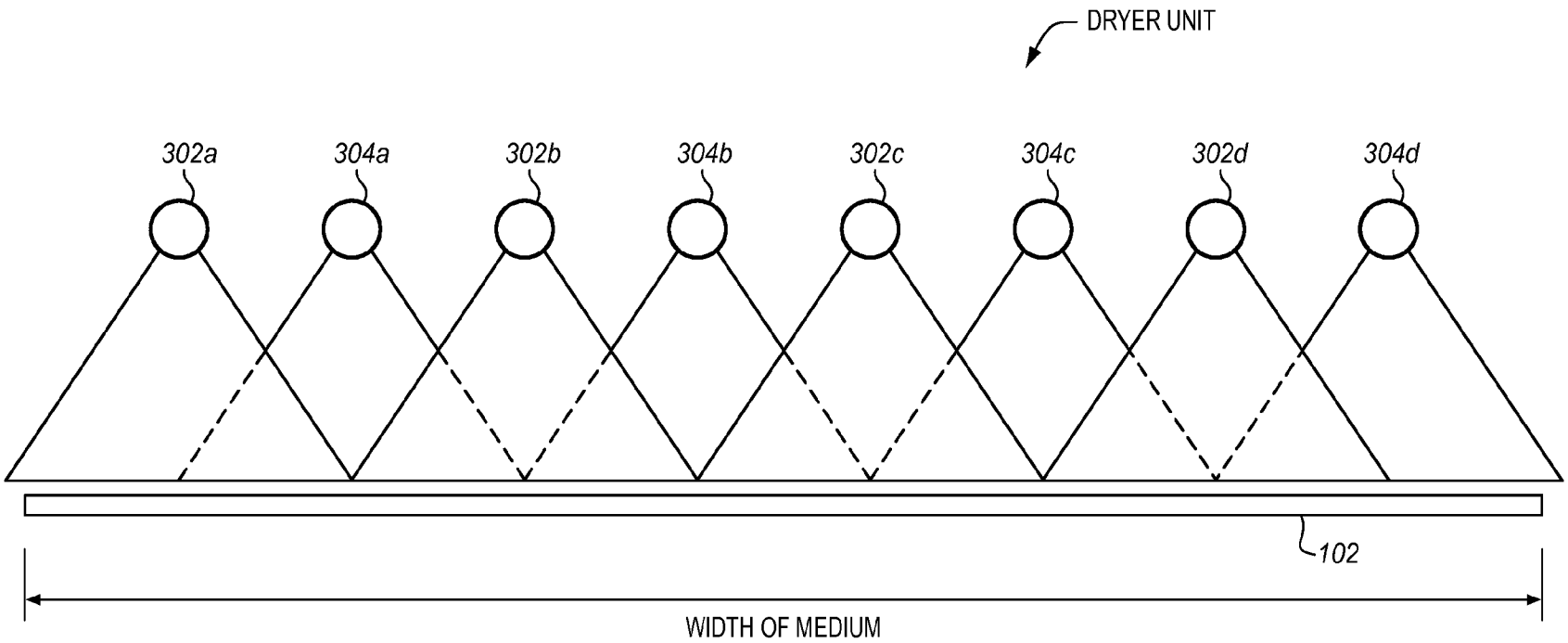
FIG. 6 illustrates a pattern of light produced by a first array of lamps and a second array of lamps across the width of a printable medium in an exemplary embodiment.

FIG. 6 illustrates a pattern of light produced by arrays 302 and 304 across the width of medium 102 in an exemplary embodiment. Lamps 302*a*, 302*b*, 302*c*, and 302*d* belong to array 302. Lamps 304*a*, 304*b*, 304*c*, and 304*d* belong to array 304. As can be seen in FIG. 6, lamps 302*a*, 302*b*, 302*c*, and 302*d* are offset from lamps 304*a*, 304*b*, 304*c*, and 304*d*. Thus, light emitted from array 302 overlaps with light emitted from array 304. For example, light emitted from lamp 304*a* overlaps with light emitted from lamps 302*a* and 302*b*. Therefore, if the light emitted from lamp 302*a* has an intensity of Ix and the light from lamp 304*a* has an intensity of Iy, the combined intensity from the two lamps is Ix+y in the area where the light overlaps.

Figure 7:
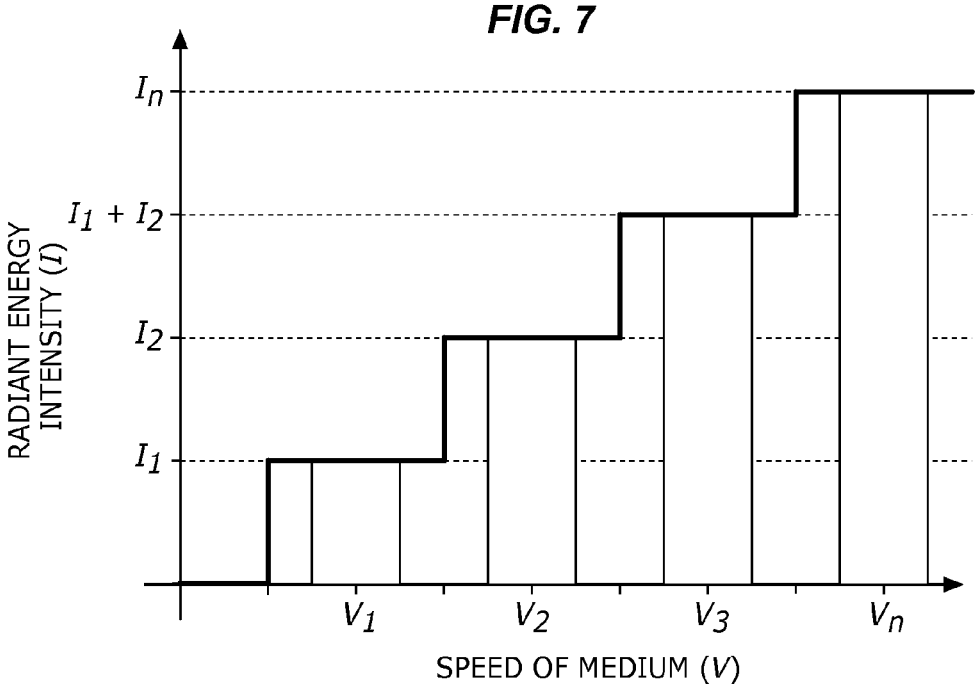
FIG. 7 is a graph illustrating the speed (V) of a printable medium in relation to the overall intensity (I) of a light source in an exemplary embodiment.

FIG. 7 is a graph illustrating the speed (V) of medium 102 in relation to the overall intensity (I) of light generated by light source 202 in an exemplary embodiment. When the speed of medium 102 is V1, controller 310 may energize the lamps of array 302 to create a target output power P1 for the lamps of array 302. When only array 302 is turned on to create the target output power P1, the overall intensity of light generated by light source 202 is $I_1$. When the speed of medium 102 increases to V2, controller 310 may energize the lamps of array 304 to create a target output power P2 for the lamps of array 304. Controller 310 also turns off the lamps of array 302. When only array 304 is turned on to create the target output power P2, the overall intensity of light generated by light source 202 is $I_2$. When the speed of medium 102 increases to V3, controller 310 may energize the lamps of array 302 to create an output power P1 for the lamps of array 302, and may also energize the lamps of array 304 to create an output power P2 for the lamps of array 304. When both arrays 302 and 304 are turned on to create their target output powers P1 and P2, respectively, the overall intensity of light generated by light source 202 is $I_{1+2}$. Thus, the intensity of light source 202 is changed by selectively energizing array 302, array 304, or both.

In order to increase the overall intensity of light generated by light source 202 above $I_{1+2}$, additional arrays of lamps may be installed in light source 202. Controller 310 may then turn on different combinations of the arrays when the speed of medium 102 increases to Vn to achieve a target intensity of $I_n$.

By selecting which lamps to turn on as shown in the above embodiments, controller 310 can change the intensity radiated onto medium 102 by light source 202. Because a target output power created by the lamps when they are energized, the wavelength of light emitted onto medium 102 remains substantially constant at an optimal value even though the intensity changes. Therefore, the effectiveness of dryer unit 200 is optimized for drying the recording liquid onto medium 102.

Figure 8:
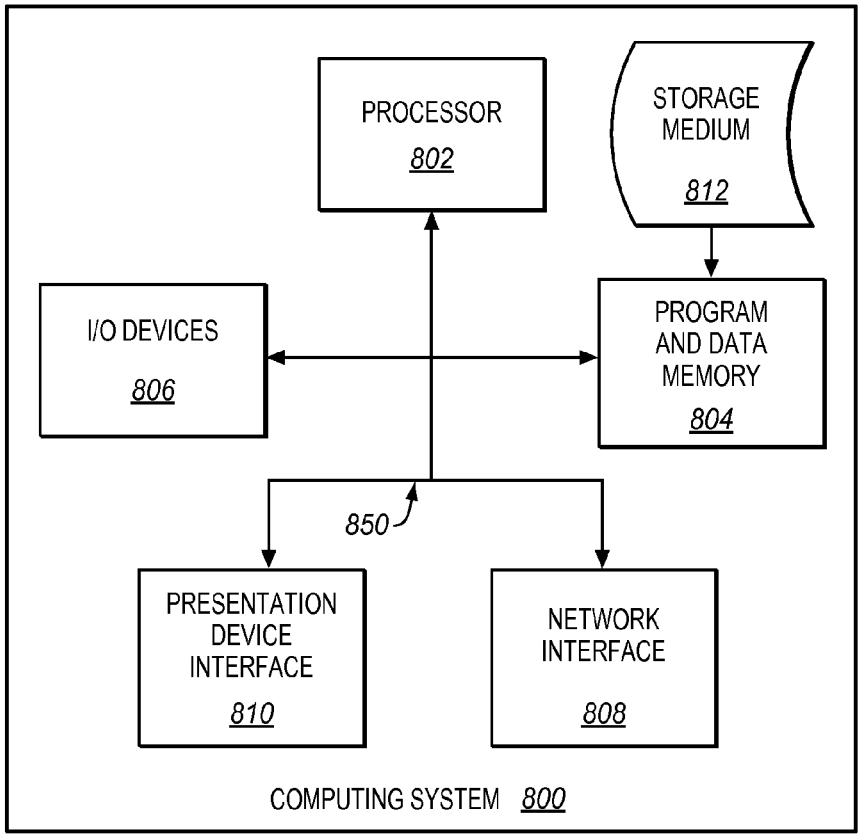
FIG. 8 illustrates a computing system in an exemplary embodiment.

The controller described herein can take the form of an entirely hardware embodiment, an entirely software embodiment or an embodiment containing both hardware and software elements. In one embodiment, the controller is implemented in software, which includes but is not limited to firmware, resident software, microcode, etc. FIG. 8 illustrates a computing system 800 in an exemplary embodiment.

Furthermore, the invention can take the form of a computer program product accessible from a computer-usable or computer-readable medium 812 providing program code for use by or in connection with a computer or any instruction execution system. For the purposes of this description, a computer-usable or computer readable medium 812 can be any apparatus that can contain, store, communicate, or transport the program for use by or in connection with the instruction execution system, apparatus, or device.

The medium 812 can be an electronic, magnetic, optical, electromagnetic, infrared, or semiconductor system (or apparatus or device) or a propagation medium. Examples of a computer-readable medium 812 include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include one or more processors 802 coupled directly or indirectly to memory 804 through a system bus 850. The memory 804 can include local memory employed during actual execution of the program code, bulk storage, and cache memories which provide temporary storage of at least some program code in order to reduce the number of times code is retrieved from bulk storage during execution.

Input/output or I/O devices 806 (including but not limited to keyboards, displays, pointing devices, etc.) can be coupled to the system either directly or through intervening I/O controllers, as can a presentation device interface (I/F) 810.

Network adapters may also be coupled to the system to enable the data processing system to become coupled to other data processing systems, such a through network interfaces 808, or remote printers or storage devices through intervening private or public networks. Modems, cable modem and Ethernet cards are just a few of the currently available types of network adapters.

Although specific embodiments were described herein, the scope of the invention is not limited to those specific embodiments. The scope of the invention is defined by the following claims and any equivalents thereof.

We claim:

1. An apparatus comprising:

a light source having a plurality of lamps that is used in a dryer unit of a printer; and a controller configured to associate a target output power with each of the lamps of the light source that produces light having an optimal wavelength for drying a recording liquid onto a printable medium;

the controller is further configured to determine a speed of the printable medium that passes through the dryer unit, and to vary an intensity of light generated by the light source based on the speed of the printable medium by varying which of the lamps of the light source are energized to their target output power, wherein the controller is further configured to energize each of the lamps solely to their target output power so that the wavelength of light emitted on the printable medium by the light source remains constant even when the intensity of light generated by the light source varies.

2. The apparatus of claim 1 wherein:

the controller is further configured to determine a target intensity of light generated by the light source based on a measured speed of the printable medium, to select a combination of lamps of the light source that provides the target intensity when the lamps are energized to their target output powers, and to energize the lamps of the selected combination to their target output powers.

3. The apparatus of claim 1 wherein:

the light source includes:

a first array of lamps; and a second array of lamps;

the controller is configured to associate a first target output power with the first array of lamps and a second target output power with the second array of lamps; and the controller is further configured to vary the intensity of light generated by the light source by one of:

energizing the first array of lamps to create the first target output power for the first array of lamps;

energizing the second array of lamps to create the second target output power for the second array of lamps; and energizing the first array of lamps and the second array of lamps to create the first target output power for the first array of lamps and create the second target output power for the second array of lamps.

4. The apparatus of claim 3 wherein:

light emitted from the first array of lamps and the second array of lamps overlap.

5. The apparatus of claim 3 wherein:

the lamps in the second array are offset from the lamps in the first array in a direction of travel of the printable medium.

6. The apparatus of claim 3 wherein:

the first array of lamps emits light having the optimal wavelength when the first target output power is created for the first array of lamps.

7. The apparatus of claim 6 wherein:

the second array of lamps emits light having the optimal wavelength when the second target output power is created for the second array of lamps, wherein the combined first and second target output power is greater than the first or second target output power alone.

8. The apparatus of claim 1 wherein:

the lamps are installed at an acute angle to the direction of travel of the printable medium.

9. A method of operating a dryer unit of a printer, wherein the dryer unit includes a light source comprising a plurality of lamps, the method comprising:

associating a target output power with each of the lamps of the light source that produces light having an optimal wavelength for drying a recording liquid onto a printable medium;

determining a speed of the printable medium that passes through the dryer unit; and varying an intensity of light generated by the light source based on the speed of the printable medium by varying which of the lamps of the light source are energized to their target output power, wherein each of the lamps is energized solely to their target output power so that the wavelength of light emitted on the printable medium by the light source remains constant even when the intensity of light generated by the light source varies.

10. The method of claim 9 wherein varying an intensity of light generated by the light source comprises:

determining a target intensity of light generated by the light source based on a measured speed of the printable medium;

selecting a combination of lamps of the light source that provides the target intensity when the lamps are energized to their target output powers; and energizing the lamps of the selected combination to their target output powers.

11. The method of claim 9 wherein the light source includes a first array of lamps and a second array of lamps, the method further includes:

associating a first target output power with the first array of lamps and a second target output power with the second array of lamps; and varying the intensity of light generated by the light source by one of:

energizing the first array of lamps to create the first target output power for the first array of lamps;

energizing the second array of lamps to create the second target output power for the second array of lamps; and energizing the first array of lamps and the second array of lamps to create the first target output power for the first array of lamps and create the second target output power for the second array of lamps.

12. The method of claim 11 wherein:

the light emitted from the first array of lamps has the optimal wavelength when the first target output power is created for the first array of lamps.

13. The method of claim 12 wherein:

the light emitted from the second array of lamps has the optimal wavelength when the second target output power is created for the second array of lamps, wherein the combined first and second target output power is greater than the first or second output power alone.

14. A printer comprising:

a print engine operable to print a recording liquid onto a printable medium; and a dryer unit operable to receive the printable medium after the recording liquid is printed onto the medium;

wherein the dryer unit includes:

a light source comprising a plurality of lamps; and a controller configured to associate a target output power with each of the lamps of the light source that produces light having an optimal wavelength for drying a recording liquid onto a printable medium;

the controller is further configured to determine a speed of the printable medium, and to vary an intensity of light generated by the light source based on the speed of the printable medium by varying which of the lamps of the light source are energized to create their target output power;

wherein the controller is further configured to energize each of the lamps solely to their target output power so that the wavelength of light emitted on the printable medium by the light source remains constant even when the intensity of light generated by the light source varies.

15. The printer of claim 14 wherein:

the controller is further configured to determine a target intensity of light generated by the light source based on a measured speed of the printable medium, to select a combination of lamps of the light source that provides the target intensity when the lamps are energized to their target output powers, and to energize the lamps of the selected combination to their target output powers.

16. The printer of claim 14 wherein:

the light source includes:

a first array of lamps; and a second array of lamps;

the controller is configured to associate a first target output power with the first array of lamps and a second target output power with the second array of lamps; and the controller is further configured to vary the intensity of light generated by the light source by one of:

energizing the first array of lamps to create the first target output power for the first array of lamps;

energizing the second array of lamps to create the second target output power for the second array of lamps; and energizing the first array of lamps and the second array of lamps to create the first target output power for the first array of lamps and create the second target output power for the second array of lamps.

17. The printer of claim 16 wherein:

light emitted from the first array of lamps and the second array of lamps overlap.

18. The printer of claim 16 wherein:

the lamps in the second array are offset from the lamps in the first array in a direction of travel of the printable medium.

19. The printer of claim 16 wherein:

the first array of lamps emits light having the optimal wavelength when the first target output power is created by the first array of lamps; and the second array of lamps emits light having the optimal wavelength when the second target output power is created by the second array of lamps, wherein the combined first and second target output power is greater than the first or second target output power alone.

20. The printer of claim 14 wherein:

the lamps are installed at an acute angle to the direction of travel of the printable medium.

* * * * *